US005511508A

United States Patent [19]

Wilson, Sr. et al.

[11] Patent Number: 5,511,508

[45] Date of Patent: Apr. 30, 1996

[54] PONTOON RUNNER SYSTEM

[75] Inventors: John M. Wilson, Sr.; Dean R. Wilson, both of Marrero, La.

[73] Assignee: Wilco Marsh Buggies & Draglines, Inc., La.

[21] Appl. No.: 230,618

[22] Filed: Apr. 21, 1994

[51] Int. Cl.[6] ..... B63B 3/00

[52] U.S. Cl. ..... 114/356; 114/270

[58] Field of Search ..... 114/61, 356, 282, 114/291, 292, 270; 305/16, 24, 25, 56

[56] References Cited

U.S. PATENT DOCUMENTS

| | | | |
|---|---|---|---|
| 2,418,610 | 4/1947 | Webb . | |
| 3,336,087 | 8/1967 | Reinsma . | |
| 3,658,392 | 4/1972 | Perreault et al. | 305/24 |
| 3,690,394 | 9/1972 | Skime | 180/5 R |
| 3,738,714 | 6/1973 | Ness | 305/24 |
| 3,770,330 | 11/1973 | Bombardier | 305/24 |
| 3,842,785 | 10/1974 | Rivet | 115/1 R |
| 4,433,634 | 2/1984 | Coast | 114/270 |
| 4,476,948 | 10/1984 | Komoto et al. | 114/270 |
| 4,667,619 | 5/1987 | Nishida | 114/361 |
| 4,846,092 | 7/1989 | Wilson | 114/270 |
| 5,139,317 | 8/1992 | Larson et al. | 305/12 |

*Primary Examiner*—Stephen Avila
*Attorney, Agent, or Firm*—Conley, Rose & Tayon

[57] ABSTRACT

An arrangement and methods are described for creating a pontoon of the type used with amphibious vehicles such as marsh buggies. A pontoon is described which features an outer shell comprised of an aluminum or aluminum alloy shell enclosing one or more water-tight chambers. The shell has an exterior surface, and one or more runners are provided upon the exterior surface which serve to both reinforce the pontoon and guide the endless chain system which drives the cleated tracks which surround the pontoon and serve to propel the vehicle. The runners are comprised of at least one longitudinal strip. The strip is disposed along and fixedly attached to the lower surface of the pontoon shell. Preferably, the strip is comprised of an aluminum or aluminum alloy-type material and is fixedly attached by means of welding to the shell. A longitudinal channel member, preferably made of steel or a steel-type alloy is disposed proximate the strip. It is preferred that the channel member be attached to the strip by means of bolting or other known engagement means.

10 Claims, 4 Drawing Sheets

PONTOON RUNNER SYSTEM

BACKGROUND OF THE INVENTION

1. Field of the Invention

The invention relates to pontoons, such as those used in marsh buggies, as well as guide channel systems which surround portions of a pontoon and serve as a guide for a continuous track drive train.

2. Description of Related Art

Amphibious vehicles have long been known which incorporate pontoons to provide flotation and to form a base for the mounting of equipment, men, or materials. The pontoons are usually surrounded by a cleated track system which is capable of engaging ground, water, or swamps to propel the vehicle. One or more endless chains are driven by a sprocket and surround the pontoon. The endless chains support the cleated tracks. The chains are guided along the outer surface of the pontoon by guide channels.

Designers have worked to improve the structure and integrity of the pontoon so that these vehicles are capable of working in more difficult terrain. Pontoons and guide channels are typically constructed of steel or steel alloys. The pontoons are capable of flotation and are useful for most situations where an amphibious vehicle is required. But these pontoons are also heavy and generate significant ground pressure.

Soft terrain environments which contain little free water tier flotation present a problem for amphibious vehicles. The pontoons will fail to float and track systems may become mired. In such situations, the amphibious vehicle must be able to generate low ground pressure to avoid becoming repeatedly stuck in the soft terrain.

Aluminum and aluminum alloy pontoons are ideal for such conditions as they afford a significant weight savings over and generate lower ground pressures than steel pontoons. But, because steel (including steel alloy type materials) and aluminum (including aluminum alloy type materials) are not readily combinable by welding, aluminum or nickel must be used for the guide channels on an aluminum pontoon. These channels wear down rather quickly when drive chains are operated within them. Bolts or other connection means could be used to directly connect a steel channel to an aluminum pontoon, but this would require puncturing the pontoon with a bolt, thereby weakening it and making it prone to leakage.

Steel also provides excellent reinforcement for an aluminum pontoon by strengthening the pontoon against both shear and bending forces and permitting it to be more resistent to punctures and other damage. It is, therefore, desirable to devise a method and arrangement for fixedly attaching a steel runner to an aluminum pontoon.

SUMMARY OF THE INVENTION

An arrangement and methods are described for providing a lightweight, durable pontoon of the type used with amphibious vehicles such as marsh buggies. A pontoon is described which features an outer aluminum or aluminum alloy shell which encloses one or more water-tight chambers. One or more runners are provided upon the exterior surface face which serve to both reinforce the pontoon and guide the endless chain system which drives the tracks which surround the pontoon and serve to propel the vehicle. The runners are comprised of at least one longitudinal strip. The strip is disposed longitudinally along and fixedly attached to the exterior surface of the pontoon shell. Preferably, the strip is comprised of an aluminum or aluminum alloy-type material and is fixedly attached by means of welding to the shell. A longitudinal channel, preferably made of steel or a steel-type alloy is disposed proximate the strip. It is preferred that the channel be attached to the strip by means of bolting or other known engagement means. When the runner has been fixedly attached to the shell, it provides a guide channel within which an endless chain of the type used to drive cleated tracks may reside.

The invention also permits the reinforcement of an aluminum-type shell with steel in a novel engagement technique. Steel-reinforced pontoons maintain the lightness associated with aluminum and provide the strength associated with steel. The channel arrangement and method taught by the present invention permit steel to be integrated with the aluminum pontoon in a way such that the pontoon need not be punctured with bolts or other connecting means in order to fixedly attach the steel runner.

DETAILED DESCRIPTION OF THE PREFERRED EMBODIMENT

The invention provides a method and arrangement for fixedly attaching runners upon a pontoon. The channels serve to guide the endless chains of a cleated track system which might typically surround the pontoon and propel the vehicle. Secondarily, the runners provide structural reinforcement for the pontoon.

Figure 1:
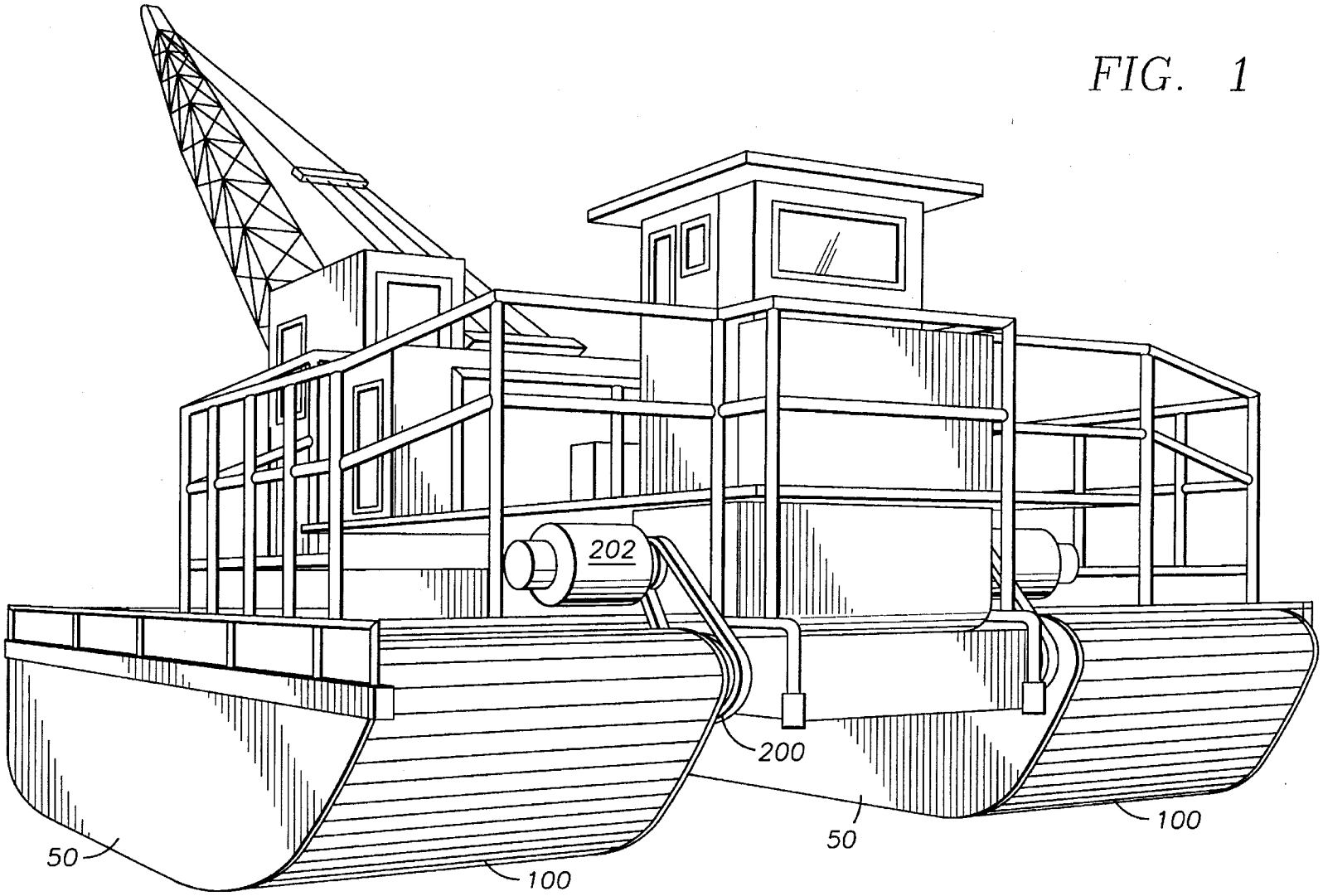
FIG. 1 shows an exemplary amphibious vehicle incorporating pontoons.

The invention features an amphibious vehicle of a type generally known in the art and which incorporates one or more floatation devices such as pontoons. These pontoons may be surrounded by a continuous track drive system. FIG. 1 shows an exemplary vehicle of this type. A cleated endless drive track 100 envelopes pontoon 60 and is driven by a drive sprocket 200 keyed thereto which is itself driven by a hydraulic motor 202. One hydraulic motor 202 is used typically for each of the pontoons 50. The hydraulic motor and drive sprocket are old in the art.

Figure 2:
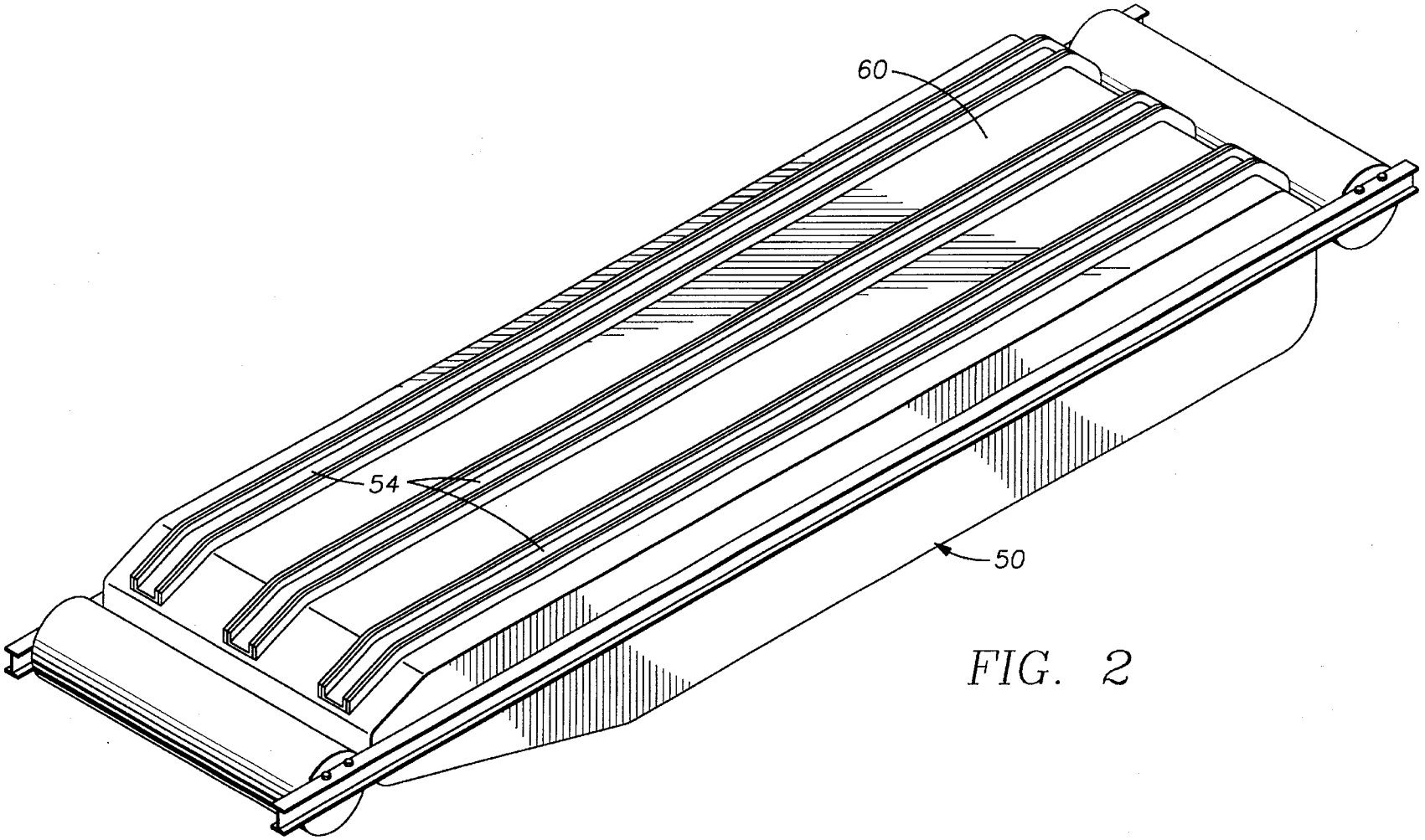
FIG. 2 is a view of a pontoon constructed in accordance with the present invention.
Figure 3:
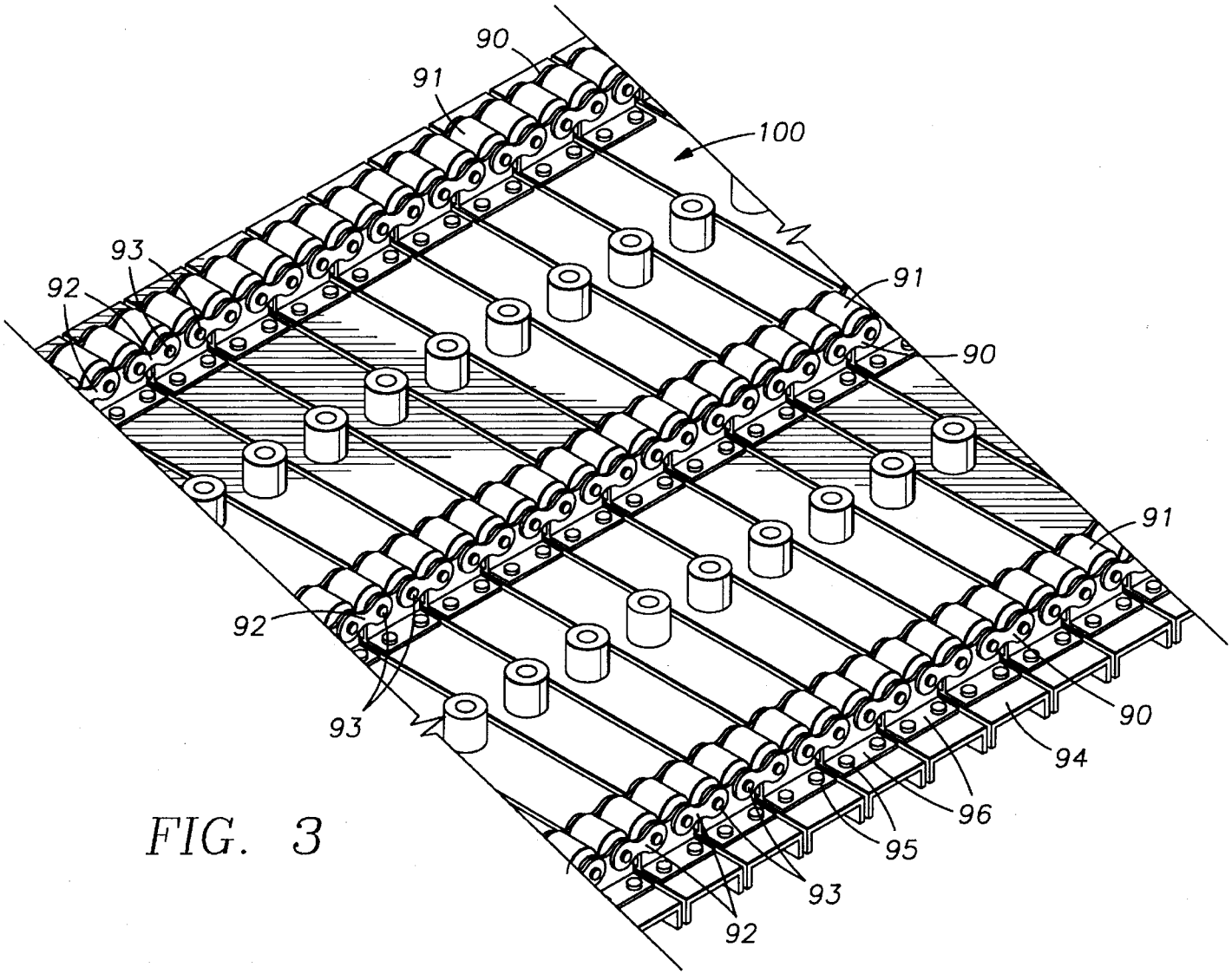
FIG. 3 is a view of an exemplary cleated track system.

Referring to FIG. 2, exemplary pontoon 50 features an outer surrounding shell 60 which encloses a water-tight area within the pontoon for flotation. Endless drive track 100, shown in detail in FIG. 3, generally surrounds and in operation is directed over portions of the exterior surface of shell 60 by drive chains 90 which may comprise links 92 and link connectors 93. The drive chains 90 also include roller elements 91, each of which rotates about a link connector 93. The drive chain 90 is attached to cleats 94 by bolts 95 and brackets 96.

The shell 60 is typically comprised of aluminum or another material of relatively low density. The term aluminum is meant in this discussion to include an aluminum-type alloy. Reference is made to U.S. Pat. No. 4,846,092, for further details of pontoon construction. Each pontoon also contains a plurality of longitudinal runners 54, which are disposed along exterior surface of the pontoon 50. It is preferred that runners 54 be disposed along portions of both the top and bottom of the pontoon 50.

Figure 4:
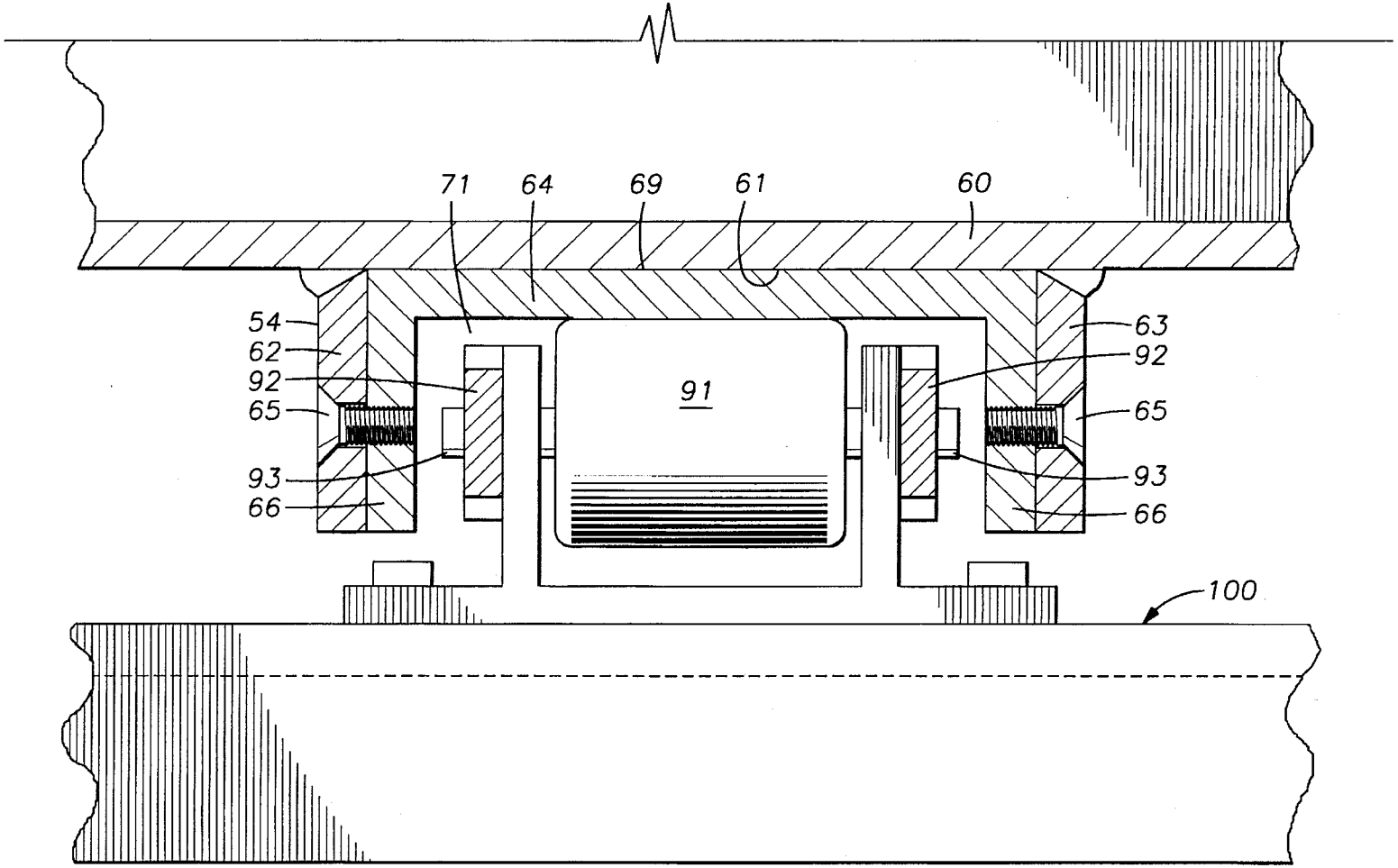
FIG. 4 shows an exemplary runner of the present invention in cross-section.

Referring now to FIG. 4, the runners 54 are positioned so as to engage a complimentary drive chain 90, for a cleated track system 100. Each runner 54 comprises at least one, but preferably a pair, of longitudinal connection strips. If two connection strips are used they are placed in a parallel relation to each other. FIG. 4 illustrates an exemplary preferred embodiment wherein two strips 62 and 63 are disposed along and fixedly attached to the outer shell 60 of the pontoon along its outer surface by means of welding. The strips are made of aluminum which are readily combinable with the shell 60 by welding.

A longitudinal channel member 64 is disposed proximate to and preferably between the strips 62, 63. The channel member 64 is preferably comprised of steel or another material more durable than aluminum. The term steel is meant to include steel-alloy materials. The channel member 64 is preferably fixedly attached to one or both strips 62, 63 by means of threaded fasteners such as bolts 65 which pass through apertures in one of the strips and into threaded bores in the channel member 64. Of course, other known engagement means may be employed such as screws, rivets, dowels and so forth.

Preferably, as well, the channel member 64 is flanged along both of its lateral sides to assist in guiding the drive chain 90 around the pontoon during operation of the track 100. Note flanges 66 in FIG. 4. In an exemplary preferred embodiment, the channel member 64 will comprise a C-beam cross-sectional structure including a flat base 69 engaging exterior surface 61 and a pair of lateral sides 66 projecting from base 69 away from surface 61. The outer surface of channel member 64 is fully supported by surface 61 and strips 62, 63. The interior surfaces of base 69 and strips 62, 63 form a channel 71 sized to receive the rollers 91 of drive chain 90. Typically, there are three rows of rollers 91 mounted on chain 90 with a channel member 64 being mounted on the exterior surface 61 of shell 60 for each row of rollers. It is preferred that channel members 64 extend completely around the peripheral surface 61 of each pontoon to fully support the rows of rollers 91 on endless chains 90. When the cleated track 100 is in place around the pontoon, the rollers 91 are housed within channel 64. The rolling periphery of each roller 91 rollingly engages the interior surface of base 69 which becomes the bearing surface for rollers 91. Further, lateral strips 62, 63 engage the sides of the rows of rollers 91 and become lateral guides to rollers 91. With channel members 64 being made of steel rather than aluminum, the steel is harder to provide a better bracing surface and is more rigid to resist the bending moments applied by the rollers 91. Thus, members 64 have a longer life and protect the less durable outer shell 60 of the pontoons which are made of aluminum.

In constructing a pontoon of the type described herein, it is contemplated that the strips 62 and 63 will be first attached to the outer surface 61 of the shell 60 and the channel member 64 bolted into place thereafter. Of course, the invention may also be practiced by reversing these steps. It is noted that the connection strips and reinforcing members will likely need to be heated and bent to conform to the shape of the pontoon's surrounding shell 60.

As those skilled in the art will recognize, the invention is subject to numerous modifications and alternative embodiments. It is noted that the invention has been described by reference to exemplary embodiments, but these are not to be construed as limiting it.

What is claimed is:

1. A lightweight amphibious vehicle substantially capable of operating in soft areas without bogging down or becoming stuck the vehicle having at least one pontoon, each pontoon comprising:

a. a shell substantially comprised of aluminum enclosing a water-tight chamber and having an exterior surface;

b. at least one longitudinal strip substantially comprised of aluminum disposed along and fixedly attached to portions of the exterior surface of said shell by welding;

c. a longitudinal channel member disposed along portions of the exterior face proximate said strip and fixedly attached to said strip by bolting, said channel member being operable to receive and partially enclose portions of a drive chain.

2. The vehicle of claim 1 wherein said channel member is substantially comprised of steel.

3. The vehicle of claim 1 wherein the channel member includes a flanged lateral side.

4. A pontoon for a lightweight vehicle which is substantially capable of operating in soft areas without bogging down or becoming stuck without having to be winched, the pontoon comprising:

a. a shell substantially comprised of aluminum enclosing a water-tight chamber and having an exterior surface;

b. at least one longitudinal strip substantially comprised of aluminum disposed along and fixedly attached to the exterior surface of said shell by welding;

c. a longitudinal channel member disposed along portions of the exterior surface proximate said strip and fixedly attached to said strip by bolting, said channel member being operable to receive and partially enclose portions of a drive chain.

5. The pontoon of claim 4 wherein said channel member is substantially comprised of steel.

6. The pontoon of claim 4 wherein the channel member includes a flanged lateral side.

7. A method of attaching a runner to a pontoon for purposes of providing a lightweight vehicle being substantially capable of operating in soft areas without bogging down or becoming stuck and having to be winched, the method comprising the steps of:

a. providing a shell comprised substantially of aluminum, said shell enclosing a water-tight chamber and having an exterior surface;

b. fixedly attaching at least one longitudinal strip substantially comprised of aluminum to the exterior surface by welding;

c. fixedly attaching a longitudinal channel member to said longitudinal strip by bolting, said channel member being operable to receive and partially enclose portions of a drive chain.

8. The method of claim 7 wherein the longitudinal channel member is substantially comprised of steel.

9. A method of attaching a runner to a pontoon for purposes of providing a lightweight vehicle being substantially capable of operating in soft areas without bogging down or becoming stuck and having to be winched, the method comprising the steps of:

a. providing a shell comprised substantially of aluminum, said shell enclosing a water-tight chamber and having an exterior surface;

b. fixedly attaching by bolting a longitudinal channel member to a longitudinal strip which is substantially comprised of aluminum, said channel member being operable to receive and partially enclose portions of a drive chain;

c. fixedly attaching said longitudinal strip to the exterior surface by welding.

10. The method of claim 9 wherein the longitudinal channel member is substantially comprised of steel.

* * * * *